US006322428B1

(12) United States Patent
Kondo

(10) Patent No.: US 6,322,428 B1
(45) Date of Patent: Nov. 27, 2001

(54) WORKING DEVICE AND WORKING METHOD FOR MAGNET MEMBER

(75) Inventor: Sadahiko Kondo, Hyogo (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/424,055

(22) PCT Filed: Apr. 2, 1999

(86) PCT No.: PCT/JP97/01741

§ 371 Date: Nov. 18, 1999

§ 102(e) Date: Nov. 18, 1999

(87) PCT Pub. No.: WO99/51394

PCT Pub. Date: Oct. 14, 1999

(30) Foreign Application Priority Data

Apr. 3, 1998 (JP) ..... 10-092042
Mar. 29, 1999 (JP) ..... 11-085617

(51) Int. Cl.[7] ..... B24B 1/00

(52) U.S. Cl. ..... 451/58; 451/177; 451/184; 451/188; 451/190; 451/300; 451/332

(58) Field of Search ..... 451/58, 177, 184, 451/188, 190, 194, 300, 332

(56) References Cited

U.S. PATENT DOCUMENTS 4,399,637 * 8/1983 Steinback ..... 451/300
4,640,056 * 2/1987 Stump ..... 451/300
5,921,850 * 7/1999 Brooks et al. ..... 451/245

FOREIGN PATENT DOCUMENTS 62-79958 4/1987 (JP) .
64-27845 * 1/1989 (JP) ..... B24B/5/40

* cited by examiner

*Primary Examiner*—Joseph J. Hail, III
*Assistant Examiner*—Shantese McDonald
(74) *Attorney, Agent, or Firm*—Armstrong, Westerman, Hattori, McLeland & Hattori, LLP

(57) ABSTRACT

A working apparatus of a magnet member comprises: a transfer path for guiding magnet members to be ground in one direction; transfer means for pushing the plurality of magnet members in a transfer direction to continuously send out the magnet members to the transfer path; a pair of grinding means disposed such as to sandwich the transfer path for grinding opposite surfaces of the transferred magnet member; and pushing means disposed downstream from the grinding means for pushing the magnet member in a direction opposite from the transfer direction. With this structure, it is possible to work the magnet member into a predetermined shape with excellent productivity.

30 Claims, 16 Drawing Sheets

WORKING DEVICE AND WORKING METHOD FOR MAGNET MEMBER

TECHNICAL FIELD

The present invention relates to a working apparatus and a working method of a magnet member for grinding various magnet members into desired shape.

BACKGROUND TECHNIQUE

As electronics are becoming smaller in size and higher in performance in recent years, magnet members are also required to be smaller in size and higher in performance, and at the same time, it is required that its cost is lowered. Therefore, when a magnet member obtained by compression molding and sintering magnet member powder is worked such as to adapt the magnet member for a predetermined use, it is required to lower the costs by enhancing the efficiency and to improve the working precision.

FIG. 1*a* shows a magnet member which is obtained by compression molding and sintering magnet material powder and which has a arc cross section. This magnet member is grounded such that the cross section is shaped like an arc as shown in FIG. 1*b* and then, it is thinly sliced into a voice coil motor magnet.

Conventionally, when a magnet member 1 of this type is ground, an apparatus shown in FIG. 2 has been used.

In FIG. 2, the reference number 3 represents a turning table, a plurality of magnet members 1 to be worked are fixed on the turning table 3, and the turning table 3 is rotated in the direction of the arrow. A grindstone 5 as a grinding means is disposed such that a flat bottom surface which is a grinding surface is in parallel to a surface of the turning table 3, and the grindstone 5 rotates in the direction of the arrow by a motor 4. The grindstone 5 is rotated, and an upper convex surface of the magnet member 1 having the arc cross section is uniformly ground by a so-called vertical axis plan grinding in which a bottom surface of the grindstone 5 is brought into contact with the upper surface of the magnet member 1 on the turn table 3 so that the magnet member 1 is formed with a flat reference surface 2 as shown in FIG. 3 which is reference for subsequent working.

Thereafter, as shown in FIGS. 4*a* and 4*b*, the magnet member 1 is transferred between a pair of guide frames 7 disposed on a table 8 in parallel to each other such that the reference surface 2 is directed downward, and the during the transfer, the upper surface, i.e., a recessed surface is ground into a predetermined shape by the grindstone 6, and the ground recessed surface is subjected to finishing polish.

Further, as shown in FIG. 5, the recessed surface of the magnet member 1 which was subjected to the finishing polish is directed downward, and the magnet member 1 is transferred between a pair of guide frames 10 disposed on a table 9 in parallel to each other, the convex surface of the magnet member 1, i.e., the surface on which the reference surface 2 was formed is ground into a predetermined shape.

Similarly, both sides of the magnet member 1 are ground to obtain a member which is to be cut into the voice coil motor magnet.

As described above, according to the conventional working apparatus, the convex surface of the magnet member is directed upward for grinding the convex surface to form the reference surface and then, the reference surface is directed downward to grind the recessed surface. Therefore, whenever the magnet member to be ground is worked, the upper and lower surfaces of the magnet member must be changed, and it is difficult to work a plurality of surfaces by continuous process. Therefore, the working process is complicated, and the production efficiency is low.

Further, in the conventional working apparatus, grinding liquid used for grinding is injected with respect to a member to be ground which is a working object so as to prevent seizing of the product.

However, it is difficult to constantly maintain the amount of grinding liquid supplied to a portion of the member to be ground. If the amount of the grinding liquid is too much, the member is ground insufficiently, and if the amount of the grinding liquid is too small, since the grinding surface of the grindstone is heated to high temperature, there is inconvenience that diamond comes out from the grindstone or the grindstone is seized.

On the other hand, when members to be ground such as rare-earth sintered magnets for example are contacted with each other and continuously transferred, especially when the members have high brittleness, there is a problem that a crack is generated due to the contact between the members.

It is an object of the present invention to solve the above-described problems, and to provide a working apparatus and a working method of a magnet member capable of continuously and effectively working a large number of magnet members into desired shape.

Especially, it is an object of the invention to provide a working apparatus and a working method of a magnet member capable of further enhancing the productivity by continuously grinding or finishing by grinding upper and lower surfaces of a magnet member.

Further, it is an object of the invention to provide a working apparatus and a working method of a magnet member which suppresses chips or cracks from being generated.

Furthermore, it is an object of the invention to provide a working apparatus and a working method of a magnet member capable of further enhancing the productivity by supplying grinding liquid more reliably and stably.

Furthermore, it is an object of the invention to provide a working apparatus and a working method of a magnet member in which grinding means is not seized or deformed easily by enhancing the permeability of grinding liquid, enhancing the cooling effect, and preventing the temperature rise of a grinding section.

DISCLOSURE OF THE INVENTION

A working apparatus of a magnet member according to a first aspect comprises: a transfer path for guiding magnet members to be ground in one direction; transfer means for pushing the plurality of magnet members in a transfer direction to continuously send out the magnet members to the transfer path; a pair of grinding means disposed such as to sandwich the transfer path for grinding opposite surfaces of the transferred magnet member; and pushing means disposed downstream from the grinding means for pushing the magnet member in a direction opposite from the transfer direction.

A working apparatus for magnet members in a first embodiment of the present invention grinds the magnet members during the process of continuously transferring the magnet members. A pair of grinding means are disposed for sandwiching a transfer path for the magnet members to simultaneously grind a plurality of surfaces of the magnet members. The working apparatus further comprises transfer means to bias the magnet member in the transfer direction for supplying the magnet member, and pushing means for pushing the magnet member which is being ground in a direction opposite from the transfer direction.

In order to enhance the productivity, it is desired to grind the plurality of surfaces of the magnet members in one step. For example, as shown in FIG. 6, the magnet member 12 is passed through between a pair of rotating grindstones 13 and 14 so that opposed surfaces of the magnet member 12 can be ground simultaneously. However, if the shapes of the two surfaces to be ground of the magnet member 12 are different from each other, or if friction forces Fa and Fb generated on the two surfaces of the magnet member 12 when the latter passes through between the grindstones 13 and 14, moment M acting to rotate the magnet member 12 is generated. Therefore, for example, if a reference surface is formed on a convex surface of the magnet member of the same shape as that shown in FIG. 1 and the recessed surface is simultaneously subjected to the grinding, the magnet member 15 is not stabilized and the magnet member 15 moves up and down, and uneven surface is formed on the worked surface 16 as shown in FIG. 7.

Thereupon, in the present invention, the arranged plurality of magnet members are pushed in the transfer direction and supplied to the pair of grinding means, and the pushing means provided at downstream from the grinding means bias the magnet member in the direction opposite from the transfer direction, thereby pushing the magnet member which is being ground from its front and rear sides.

The magnet member which is being ground is pushed and stabilized by other magnet members located in front of and behind the former magnet member, and even if moment acting to rotate the magnet member is generated by grinding operation, the magnet member is suppressed from rotating by the friction force with respect to the front and back magnet members. Therefore, it is possible to stably and simultaneously grind the plurality of surfaces of the magnet member.

According to a second aspect, in the first aspect, the pushing means is grinding means for finishing, by polishing, one of surfaces of the magnet member which has been ground by the pair of grinding means.

According to the present invention, the productivity can further be enhanced by utilizing the pushing means as the grinding means.

According to a third aspect, in the second aspect, the pair of grinding means comprise grindstones disposed above and below the transfer path, the grindstone disposed below the transfer path forms a flat surface on a lower surface of the magnet member, and the pushing means finishes, by polishing, an upper surface of the magnet member using the flat surface of the magnet member as the reference.

According to the present invention, in addition to the grinding operation of the upper and lower surfaces of the magnet member, the finishing grinding can also be carried out in one step and thus, the productivity can further be enhanced.

A working method of a magnet member according to a fourth aspect comprises the steps of: transferring a plurality of magnet members in one direction to continuously transfer the magnet members, concurrently pushing the magnet member in a direction opposite from the transfer direction, and concurrently grinding opposite surfaces of the magnet member simultaneously by a pair of grinding means disposed such as to sandwich the magnet member.

According to the present invention, it is possible to continuously grind the plurality of magnet members by pushing the magnet members in one direction to continuously transfer the magnet members, and the upper and lower surfaces of the magnet member can stably ground in one step by the pair of grinding means disposed such as to sandwich the magnet member and thus, the productivity can further be enhanced.

A working apparatus of a magnet member according to a fifth aspect is characterized in that a plurality of magnet members are continuously transferred to a transfer path, grinding means is rotated in a direction opposite from the transfer direction, and the grinding means grinds the magnet member while the grinding means pushes the magnet member in the direction opposite from the transfer direction.

According to the present invention, by rotating the grinding means in the opposite direction from the transfer direction, it is possible to apply the pushing force in the opposite direction from the transfer direction. By this pushing force, since a magnet member which is being ground is pushed and stabilized by magnet members in front of and behind the former magnet member, even if moment acting to rotate the magnet member is generated by the grinding operation, the ground magnet member is suppressed from rotating by the friction forces with respect to the front and behind magnet members. Therefore, according to this embodiment, it is possible to continuously grind the magnet members and to enhance the productivity.

A working apparatus of a magnet member according to a sixth aspect is characterized in that a plurality of magnet members are continuously transferred to a transfer path, pushing means pushes the magnet member in a direction opposite from the transfer direction, and grinding means grinds the magnet member pushed by the pushing means.

According to the present invention, by this pushing force caused from the pushing means, a magnet member which is being ground is pushed and stabilized by magnet members in front of and behind the former magnet member, and even if moment acting to rotate the magnet member is generated by the grinding operation, the ground magnet member is suppressed from rotating by the friction forces with respect to the front and behind magnet members. Therefore, according to this embodiment, it is possible to continuously grind the magnet members and to enhance the productivity.

According to a seventh aspect, in any one of the first, fifth and sixth aspects, the magnet member is a sintered magnet.

The sintered magnet is brittle and a crack is prone to be generated, but since a crack is not easily generated in the first, fifth or sixth embodiment, it is possible to stably grind the sintered magnet also, and to enhance the productivity.

According to an eighth aspect, in any one of the first, fifth and sixth aspects, an R-Fe-B rare-earth sintered magnet is used as the magnet member, and the pushing means or the grinding means applies a pushing force of 10 $kg/mm^2$ or less to the magnet member.

If a pressure of 10 $kg/mm^2$ or greater is applied to the magnet member, especially to its end portion, chips or cracks are prone to be generated, but according to the eighth embodiment, it is possible to reduce the chips or cracks, and to enhance the productivity.

According to a ninth aspect, in any one of the first, fifth and sixth aspects, guide means for suppressing the magnet member from rising from the transfer path is provided in the vicinity of the grinding means.

According to the present invention, since two magnet members in front of and behind a magnet member which is being ground are stabilized by the guide means in addition to the pushing force of the two magnet members, it is possible to stably grind the magnet member, and to enhance the productivity.

According to a tenth aspect, in the ninth aspect, the guide means is provided in front and behind the grinding means one each.

According to the tenth invention, it is possible to suppress two magnet members in front and behind a magnet member which is being ground from rising, it is possible to more stably grind the magnet member, and to enhance the productivity.

According to an eleventh aspect, in the ninth aspect, the guide means is provided with grinding liquid supplying means.

According to the present invention, it is possible to bring the guide means close to the grinding means, and to supply the grinding liquid from a position near the grinding means. Therefore, it is possible to suppress a rising movement of a magnet member which is located at a position near a magnet member which is being ground. Further, since the grinding liquid can be supplied from a position near the grinding means, it is possible to supply the grinding liquid more reliably, and the productivity can be enhanced.

According to a twelfth aspect, in the eleventh aspect, an injection direction of a grinding liquid from the grinding liquid supplying means is substantially perpendicular to a grinding surface of the grinding means.

According to the twelfth invention, since the grinding liquid is injected substantially perpendicularly, the grinding liquid is not affected by a current of air easily, the magnet member can be uniformly ground, and seizing and deformation of the grinding means are not caused easily.

According to a thirteenth aspect, in the eleventh aspect, an obstacle member is provided adjacent the grinding surface of the grinding means.

According to the present invention, since a current of air generated by the rotation of the grind means is dispersed, the grinding liquid easily attach to the grinding surface, and the seizing is not caused easily.

According to a fourteenth aspect, in the thirteenth aspect, a distance between the obstacle members and the grinding surface of the grinding means is 1 mm to 3 mm.

According to the fourteenth invention, since the amount of a current of air entering between the grinding means and the magnet member is reduced, the grinding liquid can easily enter between the grinding means and the magnet member.

According to a fifteenth aspect, in the thirteenth aspect, the obstacle members are provided in a region between 10° to 40° around the rotation axis of the grinding means back from the grinding liquid supplying means.

According to the present invention, a current of air generated by the rotation of the grinding means is divided immediately before the grinding operation to reduce the current of air and therefore, the grinding liquid can easily enter between the grinding means and the magnet member.

According to a sixteenth aspect, in the thirteenth aspect, the obstacle means is constituted by the guide means.

According to the present invention, the obstacle member can easily be positioned, and can be disposed in the vicinity of the grinding means.

A working method of a magnet member according to a seventeenth aspect is characterized in that a plurality of magnet members are continuously transferred, grinding means is rotated in a direction opposite from the transfer direction, and the magnet member is pushed in the direction opposite from the transfer direction by the grinding means and in such a state, the magnet member is ground by the grinding means.

According to the present invention, by rotating the grinding means in the opposite direction from the transfer direction, it is possible to apply the pushing force in the opposite direction from the transfer direction. By this pushing force, since a magnet member which is being ground is pushed and stabilized by magnet members in front of and behind the former magnet member, even if moment acting to rotate the magnet member is generated by the grinding operation, the ground magnet member is suppressed from rotating by the friction forces with respect to the front and behind magnet members. Therefore, according to this embodiment, it is possible to continuously grind the magnet members and to enhance the productivity.

A working method of a magnet member according to an eighteenth aspect is characterized in that a plurality of magnet members are continuously transferred, the magnet member is pushed in the opposite direction from the transfer direction by pushing means, and the magnet member pushed by the pushing means is ground by grinding means.

According to the present invention, by this pushing force caused from the pushing means, a magnet member which is being ground is pushed and stabilized by magnet members in front of and behind the former magnet member, and even if moment acting to rotate the magnet member is generated by the grinding operation, the ground magnet member is suppressed from rotating by the friction forces with respect to the front and behind magnet members. Therefore, according to this embodiment, it is possible to continuously grind the magnet members and to enhance the productivity.

According to a nineteenth aspect, in any one of the fourth, seventeenth and eighteenth aspects, the magnet member is a sintered magnet.

The sintered magnet is brittle and a crack is prone to be generated, but since a crack is not easily generated in the fourth, seventeenth or eighteenth embodiment, it is possible to stably grind the sintered magnet also, and to enhance the productivity.

According to a twentieth aspect, in any one of the fourth, seventeenth and eighteenth aspects, an R-Fe-B rare-earth sintered magnet is used as the magnet member, the magnet member is pushed by a pushing force of 10 kg/mm$^2$ or less and is transferred.

If a pressure of 10 kg/mm$^2$ or greater is applied to the magnet member, especially to its end portion, chips or cracks are prone to be generated, but according to the eighth embodiment, it is possible to reduce the chips or cracks, and to enhance the productivity.

According to a twenty-first aspect, in any one of the fourth, seventeenth and eighteenth aspects, a grinding liquid is injected to the grinding means.

According to the twenty-first invention, since the grinding liquid can reliably be injected to the grinding means, seizing is not caused, and the grinding means is not worn easily. Further, scraps will not pile up easily.

According to a twenty-second aspect, in the twenty-first aspect, the injection pressure of the grinding liquid is 5 kg/cm$^2$ or greater.

According to the present invention, since the grinding liquid is reliably injected by the grinding means with high pressure, the seizing is not caused easily, and the friction of the grinding means is reduced, the grinding force of the grinding means is not lowered and therefore, the efficiency of the grinding working is enhanced.

According to a twenty-third aspect, in the twenty-first aspect, a grinding liquid having surface tension of 25 dyn/cm$^2$ to 60 dyn/cm$^2$ is used as the grinding liquid.

According to the present invention, since the permeability is superior and scraps are easily discharged and thus, the grinding working can be carried out efficiently. If the surface tension is smaller than 25 dyn/cm$^2$, the grinding liquid permeates excessively and the grinding means rotates free. On the other hand, if the surface tension exceeds 60 dyn/cm$^2$, the grinding liquid does not permeate easily between the magnet member and the grinding member and thus, the grinding resistance is increased and seizing of the grinding means is generated.

According to a twenty-fourth aspect, in the twenty-first aspect, the coefficient of kinetic friction between the magnet member and the grinding means is set to 0.1 to 0.3 by using the grinding liquid.

According to the present invention, the friction of the grinding means is reduced, the grinding force of the grinding means is not lowered and therefore, the efficiency of the grinding working is enhanced.

According to a twenty-fifth aspect, in the twenty-first aspect, a grinding liquid comprising water as the main ingredient is used as the grinding liquid.

According to the present invention, since water has high cooling effect, it is possible to enhance the cooling effect of the grinding means, and the seizing is not caused easily. Further, it is possible to effectively prevent powder of diamond from coming off, for example.

According to a twenty-sixth aspect, in the twenty-first aspect, an antifoaming agent is included in the grinding liquid.

According to the present invention, the grinding liquid is not frothed easily at the time of grinding working, the permeability of the grinding liquid is enhanced, the cooling effect is also enhanced, the temperature rise due to the grinding portion is prevented and therefore, seizing or deformation of the grinding means is not caused easily.

According to a twenty-seventh aspect, in the twenty-first aspect, the grinding liquid is injected to the grinding surface of the grinding means substantially perpendicularly.

According to the present invention, since the grinding liquid is injected substantially perpendicularly, even if the grinding liquid is influenced by a current of air generated by the rotation of the grinding means, the grinding liquid is reliably supplied, and seizing and deformation of the grinding means are not caused easily.

According to a twenty-eighth aspect, in any one of the fourth, seventeenth and eighteenth aspects, an end of the magnet member is chamfered before it is transferred.

According to the present invention, since pressure load is not concentrated on the end of the magnet member, cracks are not generated when magnet members are contacted with each other at the time of the grinding working.

According to a twenty-ninth aspect, in the twenty-eighth aspect, a width of the chamfer of the magnet member is 1 mm to 5 mm.

As in the present invention, in order to prevent the cracks from being generated when magnet members are contacted with each other and to satisfy the yield, the chamfer width may be in a range from 1 mm to 5 mm.

According to a thirtieth aspect, in the twenty-eighth aspect, an chamfer angle of the magnet member is 60° to 80° with respect to the grinding surface of the magnet member.

As in the present invention, in order to prevent the cracks from being generated when magnet members are contacted with each other, the chamfer angle between 60° and 80° with respect to the grinding surface of the magnet member is suitable.

A magnet member according to a thirty-first aspect is ground using the working apparatus of the magnet member according to any one of the first, fifth and sixth aspects.

According to the present invention, it is possible to obtain a magnet member in which failure is less generated and dimensional accuracy is high.

A magnet member according to a thirty-second aspect is ground using the working method of the magnet member according to any one of the fourth, seventeenth and eighteenth aspects.

According to the present invention, it is possible to obtain a magnet member in which failure is less generated and dimensional accuracy is high.

BRIEF DESCRIPTION OF THE DRAWINGS

FIGS. 4*a* and 4*b* are explanatory views of a step for grinding a recessed surface of the magnet member in the conventional working method of the magnet member, wherein FIG. 4*a* is a transverse sectional view of an essential portion showing a state of the magnet member and the working apparatus at the time of grinding working, and FIG. 4*b* is a side view thereof;

FIGS. 10*a* and 10*b* are explanatory views of a grinding step of the magnet member using the working apparatus, wherein FIG. 10*a* is a transverse sectional view of an essential portion of the magnet member and a working apparatus, and, FIG. 10*b* is a side view thereof;

BEST MODE FOR CARRYING OUT THE INVENTION

First, the grinding operation of the present invention will be explained with reference to FIG. 8.

As grinding means, rotation grindstones are used generally. The rotation grindstones are rotated such that its grinding resistance is generated in a direction of the transfer direction of the magnet member or a direction opposite from the transfer direction thereof. If the directions of the grinding resistance generated in the pair of rotation grindstones are different from each other, great moment is generated in a magnet member which is being ground and therefore, it is preferable to rotate the grindstones such that the directions of the grinding resistance are coincide with each other.

Figure 8:
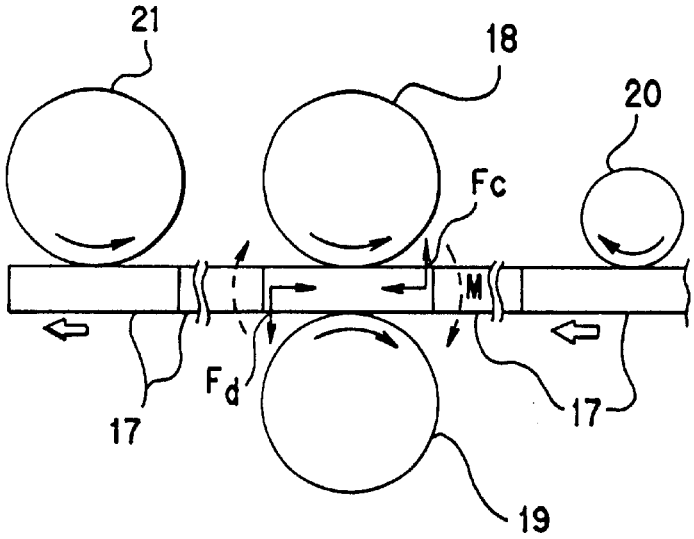
FIG. 8 is a view showing a model of distribution of force generated in the magnet member when opposite surfaces of the magnet member are ground using pushing means according to a working method of the magnet member of the invention.

The magnet members 17 are transferred in the left direction in FIG. 8 while being pushed by transfer means such as a roller 20 or the like. If the magnet member 17 passes through between the rotating grindstones 18 and 19, moment M acting to rotate the magnet member 17 as shown with broken lines in FIG. 8 is generated in the magnet member 17 as described above. Here, since the magnet member 17 is pushed by a subsequent magnet member 17, friction force Fc acts in a direction to suppress the rotation due to the moment M. Further, since pushing means such as a reverse roller 21 or the like is disposed downstream from the grindstones 18 and 19 for pushing the magnet member 17 in a direction opposite from the transfer direction, pushing force acts on a front end surface of the magnet member 17 passing between the grindstones 18 and 19 through a front magnet member 17. Therefore, friction force Fd similarly acts in a direction to suppress the rotation due to the moment M. Since the magnet member 17 is stabilized by both the friction force, front and rear portions of the magnet member 17 do not vertically move or thrash, and the magnet member 17 stably passes through between the grindstones 18 and 19 and are ground.

<First Embodiment>

Figure 1A:
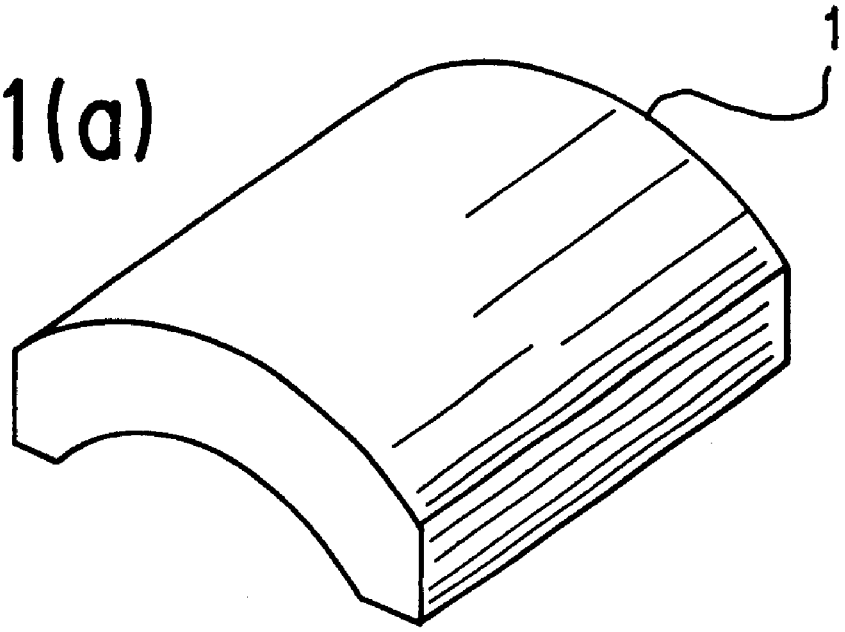
FIGS. 1*a* and 1*b* are a perspective view and a transverse sectional view, respectively, showing a magnet member to be worked in embodiments of the present invention.
Figure 1B:
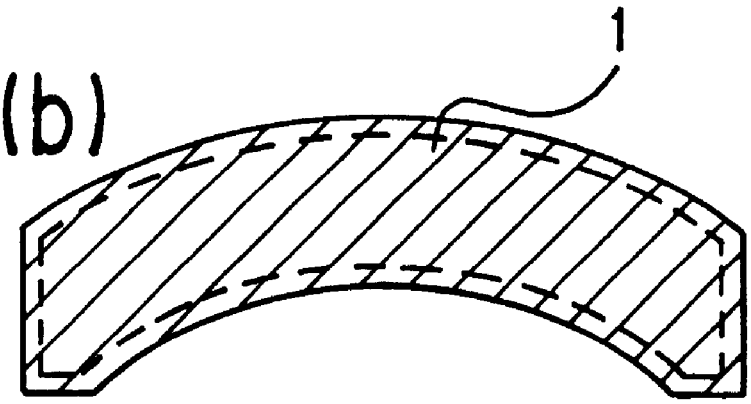
Figure 2:
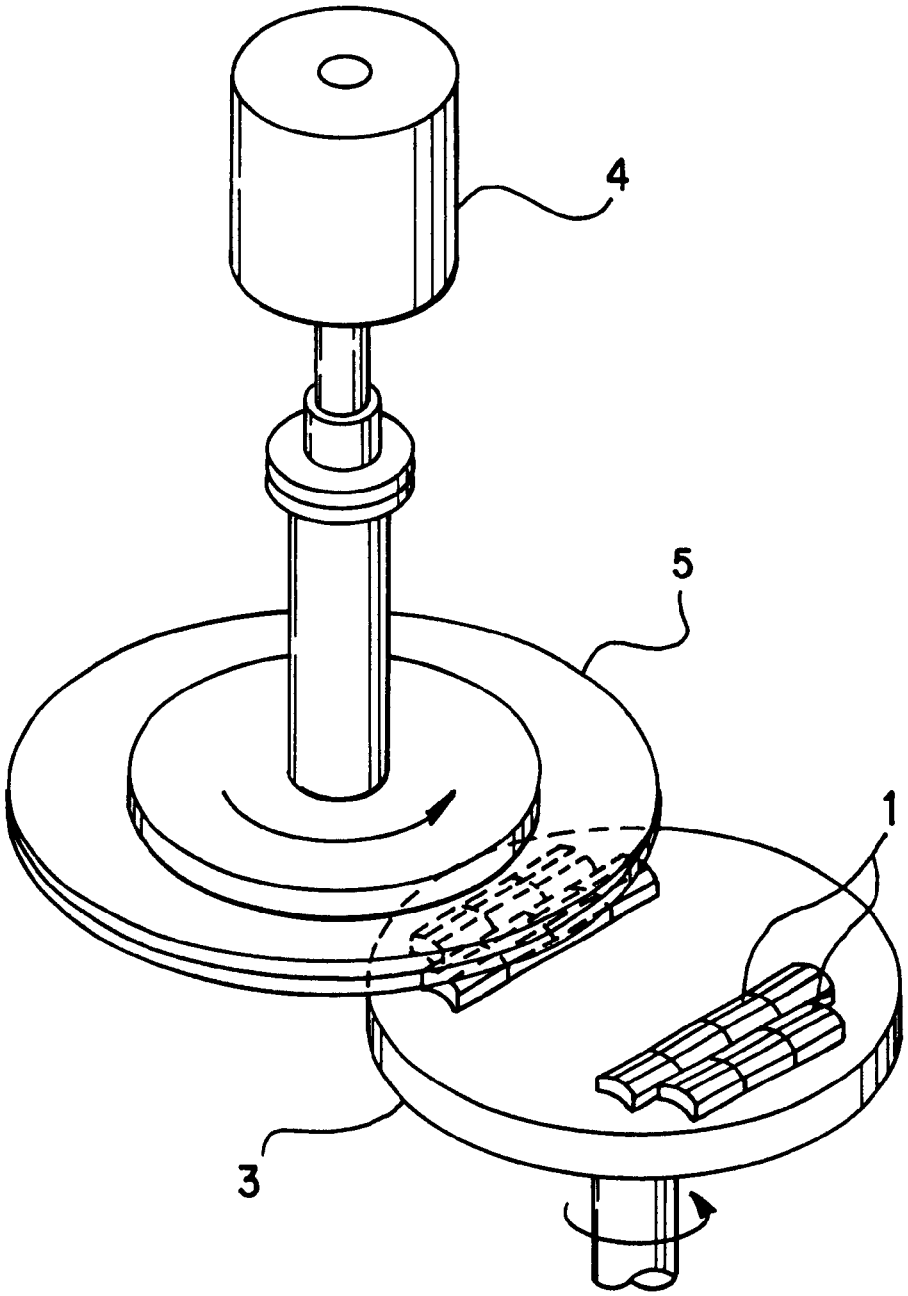
FIG. 2 is a perspective view showing a state of a magnet member and a working apparatus in a step for forming a reference surface on the magnet member in a conventional working method of the magnet member.
Figure 3A:
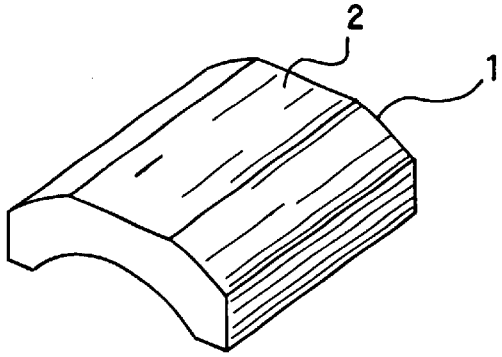
FIGS. 3*a* and 3*b* are a perspective view and a transverse sectional view of an essential portion of the magnet member formed with the reference surface in the step.
Figure 3B:
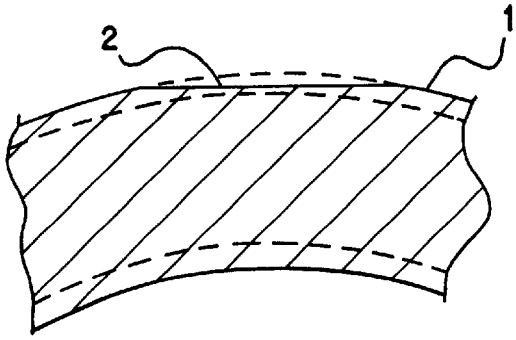
Figure 4A:
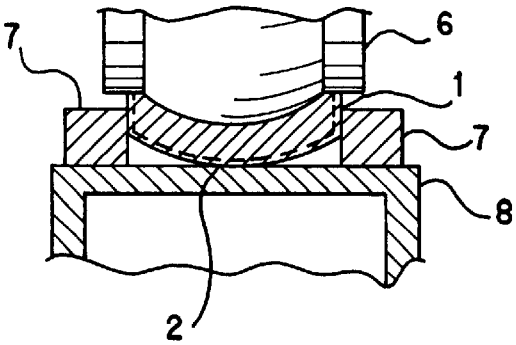
Figure 4B:
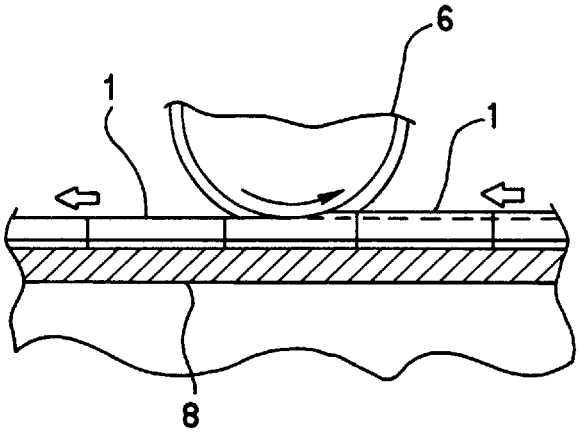
Figure 9:
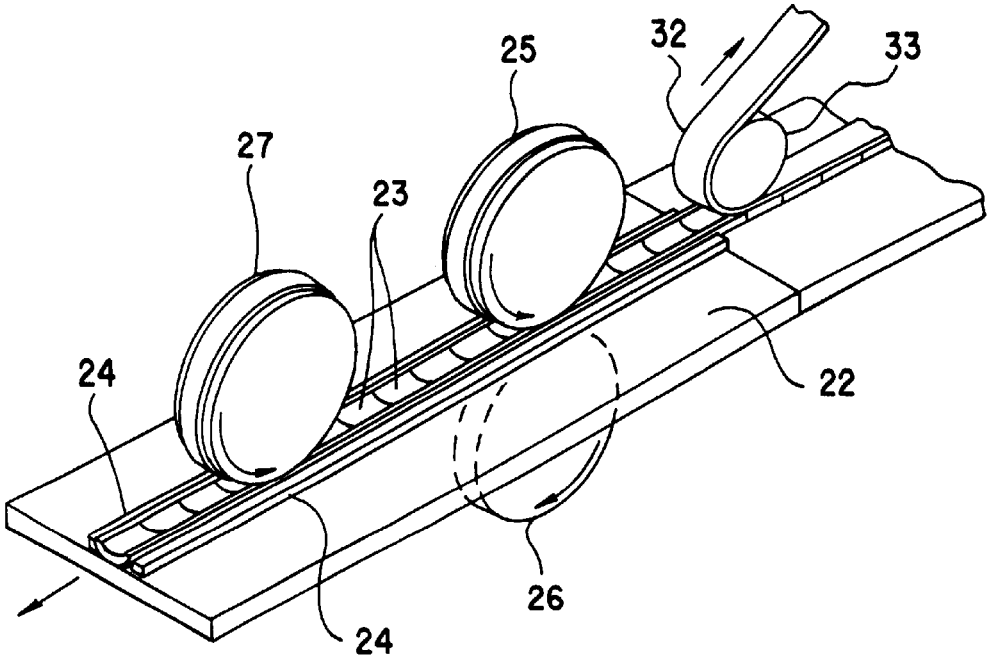
FIG. 9 is a perspective view showing an essential portion of a working apparatus of a magnet member according to an embodiment of the invention.

FIG. 9 shows an essential portion of a working apparatus of a magnet member of the first embodiment. A pair of parallel guide frames 24 for guiding a magnet member 23 are disposed on a table 22 constituting a transfer path. The magnet member 23 has the same shape as that shown in FIG. 1, a width of the magnet member 23 is 40 mm, and a length thereof is 60 mm. A belt 32 wound around a roller 33 and a plurality of rollers (not shown) continuously supplies the magnet members 23 between the pair of guide frames 24 at the speed of 100 mm/minute, for example. The roller 33 and the belt 32 constitute transfer means. At that time, the magnet member 23 is supplied such that its recessed surface is directed upward. The magnet member 23 supplied to the transfer path is transferred along the guide frames 24 which being pushed by a subsequent magnet member 23.

A roughly-working grindstone 25 and a reference surface working grindstone 26 are disposed such as to oppose to each other above and below the transfer path of the magnet member 26. The roughly-working grindstone 25 and the reference surface working grindstone 26 constitute a pair of grinding means. The roughly-working grindstone 25 and the reference surface working grindstone 26 rotate at higher speed as compared with the transfer speed of the magnet member 23 (e.g., 2000 m/minute).

Diamond grindstone powder is electrolytically deposited on the grinding surface of each of the roughly-working grindstone 25 and the reference surface working grindstone 26. It is preferable that the size of the diamond grindstone power is 100 $\mu$m to 500 $\mu$m. If the size of the diamond grindstone powder exceeds 500 $\mu$m, although the grinding amount is increased, the degree of unevenness is increased. Further, the size is smaller than 100 $\mu$m, the finished surface is excellent, but since the grinding amount is small, the productivity is inferior.

Figure 10A:
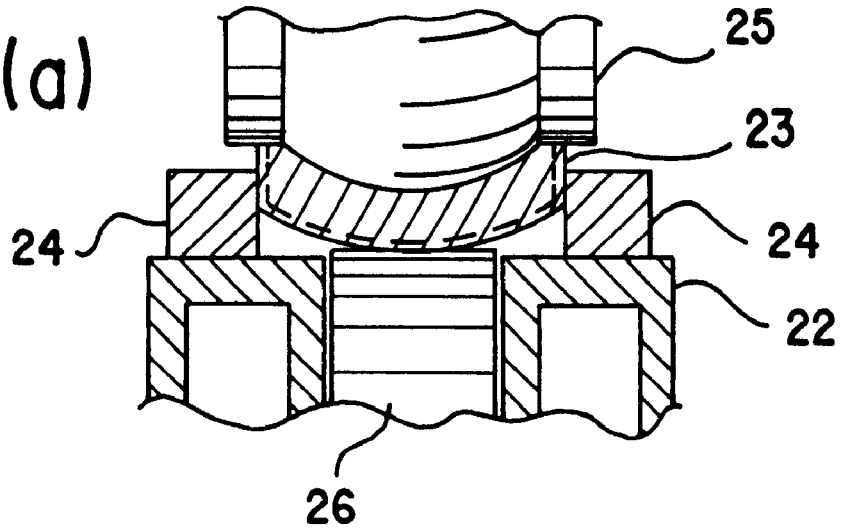
Figure 10B:
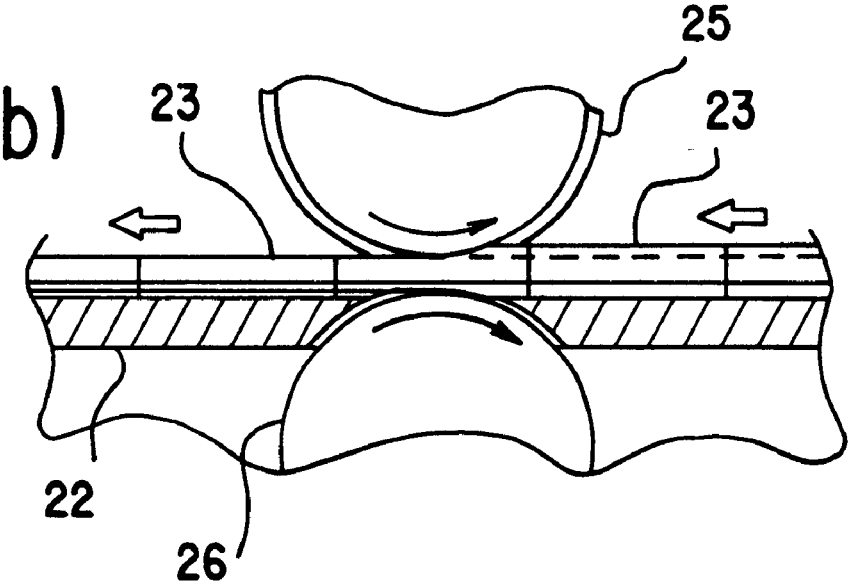

The magnet member 23 transferred along the guide frame 24 passes between the roughly-working grindstone 25 and the reference surface working grindstone 26, and is ground as shown in FIGS. 10*a* and 10*b*. The roughly-working grindstone 25 disposed above the transfer path has a grinding surface corresponding to a recess shape of the magnet member which is to be obtained. On the other hand, the reference surface working grindstone 26 has a flat reference surface. Therefore, when the magnet member 23 passes through between the roughly-working grindstone 25 and the reference surface working grindstone 26, a lower protruded surface of the magnet member 23 is formed with a flat reference surface, and an upper recessed surface is ground into a predetermined shape based on the reference surface.

A finishing working grindstone 27 having function of pushing means is disposed above the table 22 of the magnet member 23 downstream from the roughly-working grindstone 25 and the reference surface working grindstone 26. The finishing working grindstone 27 is disposed above the table 22, and is rotated such that the pushing force is applied to the magnet member 23 in a direction opposite from the transfer direction thereof. That is, the finishing working grindstone 27 polishes, as the finishing touches, the recessed surface ground by the roughly-working grindstone 25 of the magnet member 23, and pushes the magnet member 23 in the opposite direction from the transfer direction. The rotation speed of the finishing working grindstone 27 is set to the same as those of the roughly-working grindstone 25 and the reference surface working grindstone 26 for example.

In the above embodiment, it is preferable that the pushing force applied to the magnet member 23 by the roughly-working grindstone 25, the reference surface working grindstone 26 or the finishing working grindstone 27 is 10 kg/mm$^2$ or less if an R-Fe-B rare-earth sintered magnet is used as the magnet member. By setting the pressure applied to the magnet member 23 to 10 kg/mm$^2$ or less in this manner, it is possible to suppress chips or cracks from being generated in the magnet member 23 which is sintered body and fragile, especially in its end.

<Second Embodiment>

In the second embodiment, a working apparatus of a magnet member for grounding opposite sides of the magnet member which is the same as that used in the first embodiment will be explained.

Figure 11:
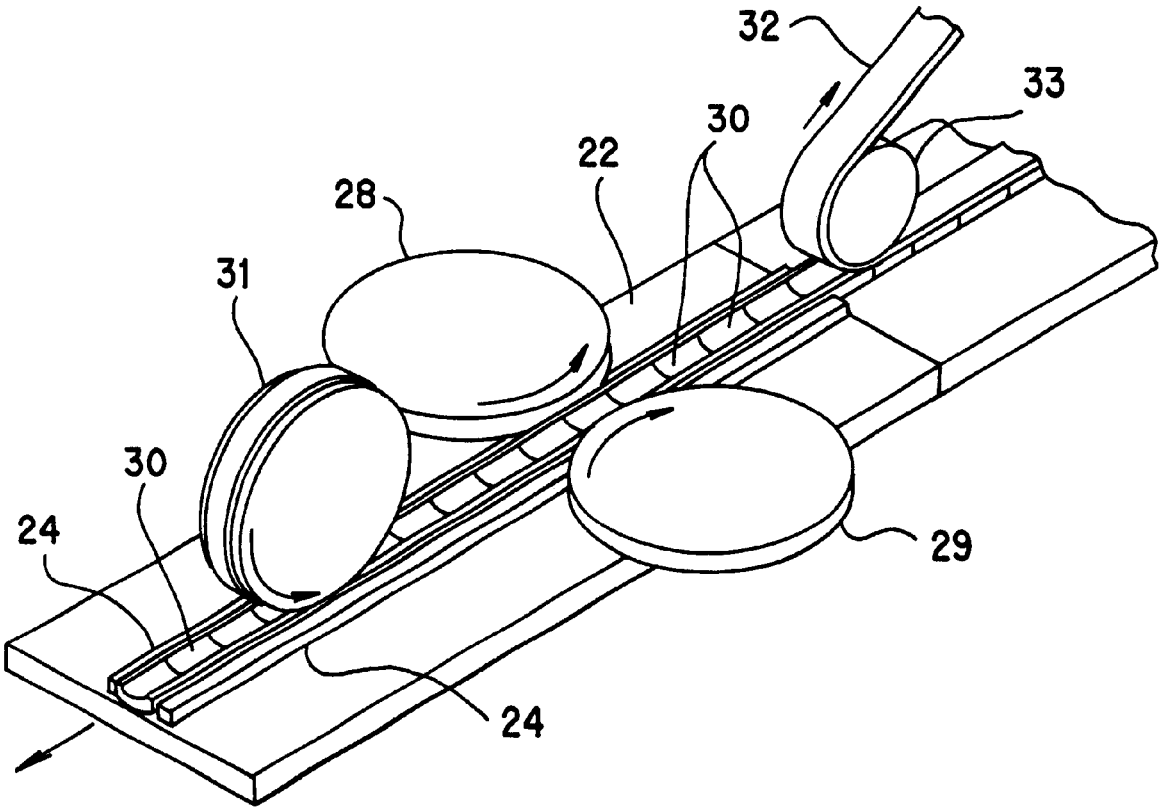
FIG. 11 is a perspective view showing an essential portion of a working apparatus of a magnet member of another embodiment of the invention.

The structure of the working apparatus shown in FIG. 11 is substantially the same as that in the first embodiment. However, instead of the roughly-working grindstone 25 and the reference surface working grindstone 26, side grinding grindstones 28 and 29 are disposed such as to oppose to each other on the right and left sides of the transfer path of a magnet member 30. When the magnet member 30 passes through between the grindstones 28 and 29, the opposite sides of the magnet member 30 are simultaneously ground, and the width of the magnet member 30 is worked into a predetermined size. In the drawing, the protruded surface of the magnet member 30 transferring on the transfer path is formed with the above-described reference surface.

In this working apparatus, a recessed surface working grindstone 31 as pushing means is disposed downstream from the grindstones 28 and 29 of the transfer path for the magnet member 30. Therefore, the magnet member 30 passes through the recessed surface working grindstone 31, and the recessed surface of the magnet member 30 is ground. If the recessed surface is not ground at all, the roughly-working grindstone is used as the recessed surface working grindstone 31. If the recessed surface is not roughly ground, the finishing working grindstone is used.

Figure 5:
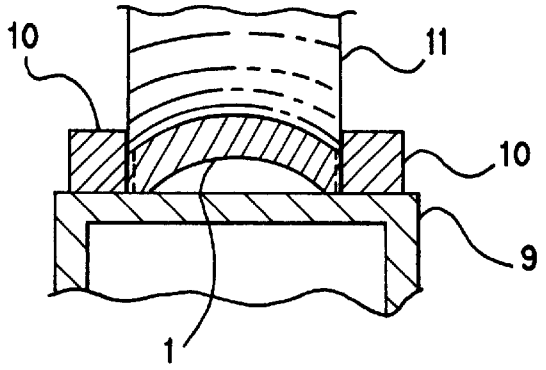
FIG. 5 is a transverse sectional view of an essential portion showing a state of the magnet member and the working apparatus in a step for grinding a protruded surface of the magnet member in the conventional working method of the magnet member.
Figure 6:
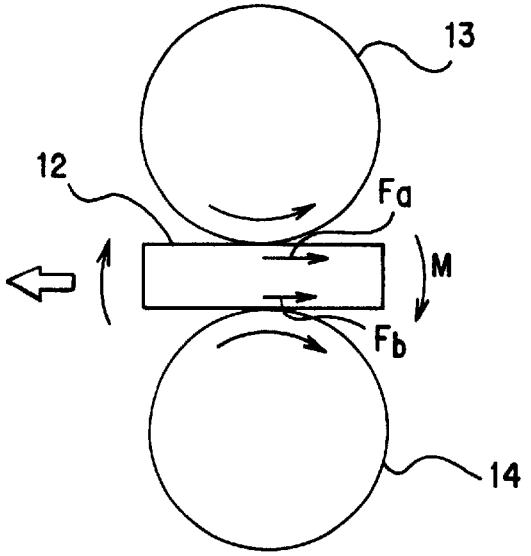
FIG. 6 is a view showing a model of distribution of force generated in the magnet member when opposite surfaces of the magnet member are ground without using pushing means.
Figure 7:
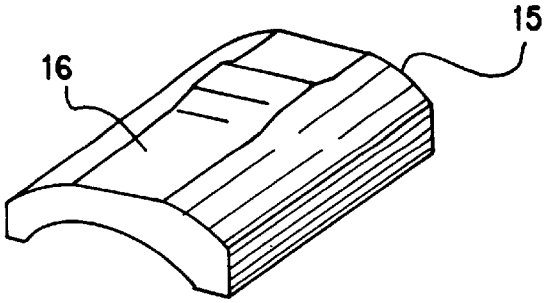
FIG. 7 is a perspective view showing a magnet by the grinding working.

Like the magnet member which is ground in the first embodiment, if the recessed surface is subjected to the finishing working but the protruded surface is not formed into a final shape, a protruded surface working grindstone 11 as shown in FIG. 5 is used instead of the recessed surface working grindstone 31, and the magnet member is supplied to the transfer path such that the recessed surface of the magnet member is directed downward. With this operation, the side of the magnet member is worked, and its protruded surface is worked into the predetermined shape.

As described above, according to the present embodiment, it is possible to grind the opposite sides of the magnet member and to also work the recessed surface or the protruded surface thereof.

If both the recessed surface and the protruded surface of the magnet member whose side is to be ground have already been worked, it is unnecessary to use the grindstone, and a rubber roller which only functions as the pushing means is used instead of the grindstone.

<Third Embodiment>

Next, a working apparatus of a magnet member according to a third embodiment of the invention will be explained with reference to FIGS. 12 and 13. Members having the same function as that of the constituent members explained in the first embodiment are designated with the same reference numbers, and detailed explanation thereof will be omitted.

Figure 12:
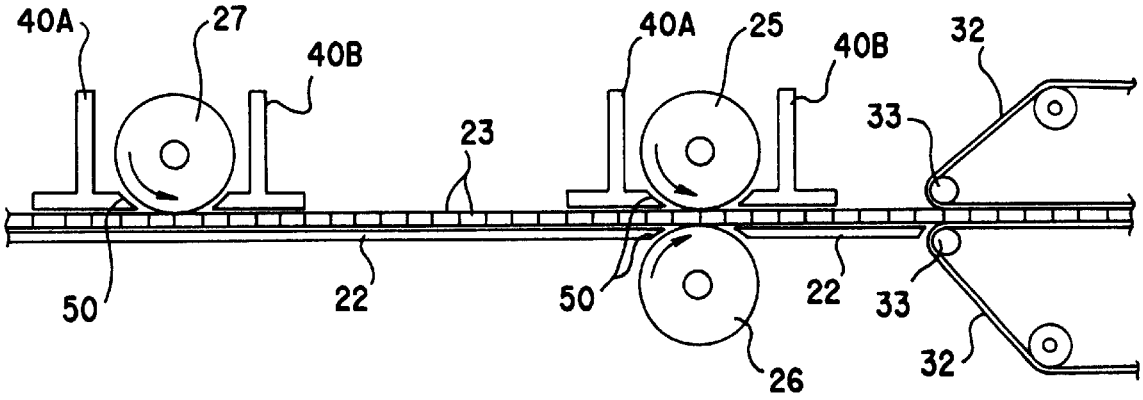
FIG. 12 is a view showing a structure of a working apparatus of a magnet member of another embodiment of the invention.

As shown in FIG. 12, in the present embodiment, guide means 40A and 40B for restraining the magnet member 23 from rising from the table 22 are disposed in the vicinity of the roughly-working grindstone 25 and the finishing working grindstone 27. Here, the guide means 40A is disposed in the vicinity of the transfer-out side of the magnet member 23 from the roughly-working grindstone 25 and the finishing working grindstone 27, and the guide means 40B is disposed in the vicinity of the transfer-in side of the magnet member 23 to the roughly-working grindstone 25 and the finishing working grindstone 27. These guide means 40A and 40B are provided such that they are in contact with the upper surface of the magnet member 23 or are slightly separated therefrom.

The guide means 40A is also provided with grinding liquid supplying means 50. The table 22 at the transfer-out side of the reference surface working grindstone 26 is also provided with grinding liquid supplying means 50.

Figure 13:
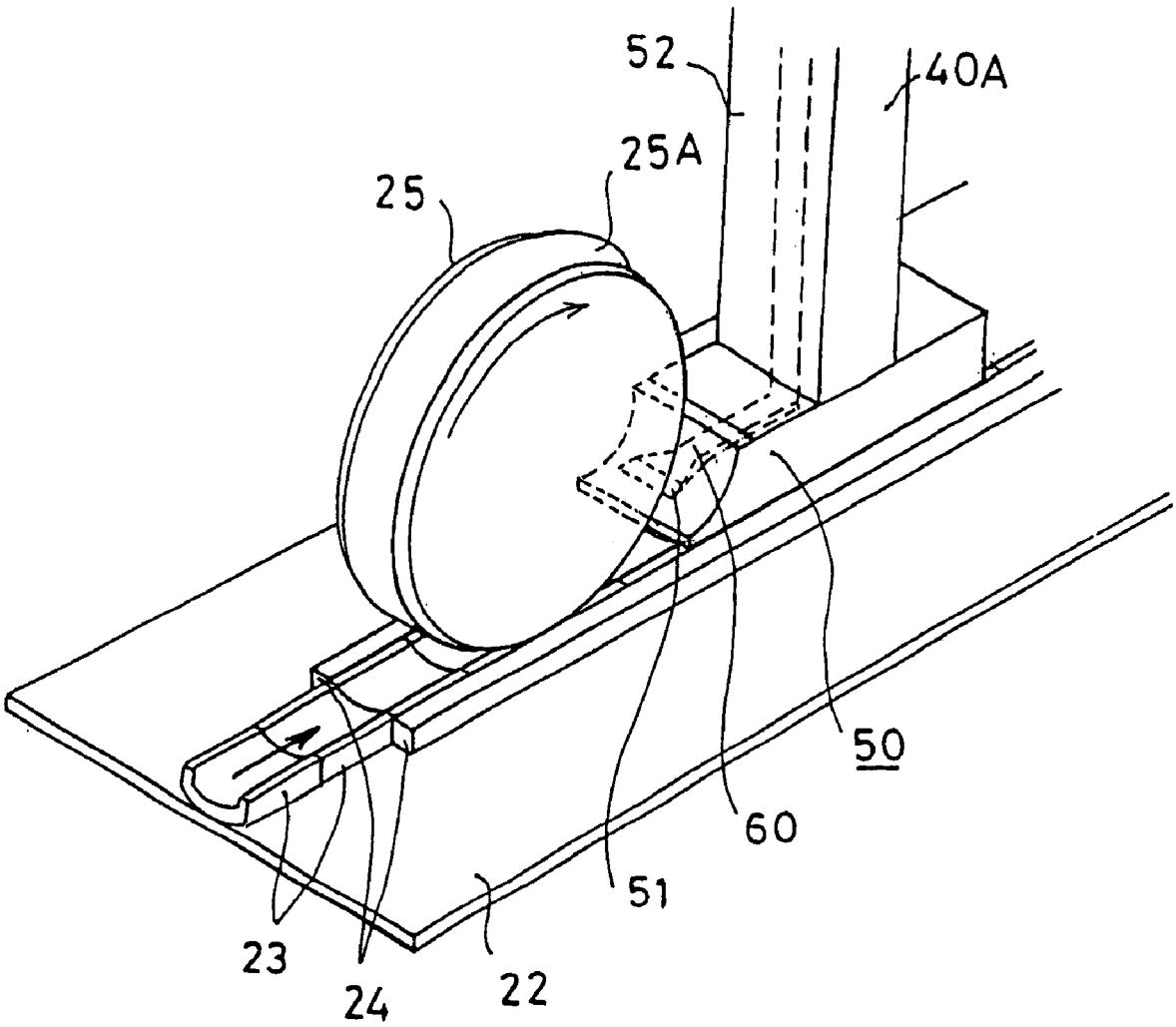
FIG. 13 is a perspective view showing an essential portion of the working apparatus of the magnet member of the embodiment.

As shown in FIG. 13, each of the grinding liquid supplying means 50 includes an injection nozzle 51 and a supply passage 52 for supplying the grind liquid to the injection nozzle 51. The injection nozzle 51 is directed toward a grinding surface 25A of the roughly-working grindstone 25. At that time, it is preferable that the injection direction of the injection nozzle 51 is perpendicular to the grinding surface 25A. It is also preferable that the injection pressure of the grinding liquid from the injection nozzle 51 is 5 kg/cm$^2$ or greater. By setting the injection direction and injection pressure in this manner, it is possible to constantly supply, to the grindstone, the grinding liquid which is prone to receive the influence of a current of air generated when the grindstone rotates at a high speed.

It is preferable that the grinding liquid comprises water as the main ingredient. Since the grinding liquid comprising water as the main ingredient has high cooling effect, it is possible to enhance the cooling effect of the grinding means by using such a grinding liquid, and the seizing is not caused easily. Further, it is preferable that a grinding liquid including antifoaming agent is used. By including the antifoaming agent, the grinding liquid is not frothed easily at the time of grinding working, the permeability of the grinding liquid is enhanced, the cooling effect is also enhanced, the temperature rise due to the grinding portion is prevented and therefore, seizing or deformation of the grinding means is not caused easily.

Further, it is preferable that grinding liquid having surface tension of 25 dyn/cm$^2$ to 60 dyn/cm$^2$ is used. If the surface tension if smaller than 25 dyn/cm$^2$, the grinding liquid permeates excessively and the grinding means rotates free. On the other hand, if the surface tension exceeds 60 dyn/cm$^2$, the grinding liquid does not permeate easily between the magnet member 23 and the roughly-working grindstone 25 and thus, the grinding resistance is increased and seizing of the grinding means is generated. Furthermore, the coefficient of kinetic friction between the magnet member 23 and the roughly-working grindstone 25 or the reference surface working grindstone 26 is set to 0.1 to 0.3 by using such a grinding liquid. By setting the coefficient of kinetic friction in a range of 0.1 to 0.3, the seizing is not caused easily, the friction of the roughly-working grindstone 25 or the reference surface working grindstone 26 is reduced, the grinding force of the grinding means is not lowered and therefore, the efficiency of the grinding working is enhanced.

As shown in FIG. 13, a surface of the guide means 40A at the side of the roughly-working grindstone 25 is formed with an obstacle member 60 comprising an arc surface which is substantially concentric with the grinding surface 25A. This obstacle member 60 is for reducing influence of a current of air generated by the rotation of the roughly-working grindstone 25 acting on the injection nozzle 51.

Therefore, when the obstacle member 60 comprising the arc surface which is substantially concentric with the grinding surface 25A is formed, it is preferable that the arc surface is provided in a range of 10 ° with respect to the rotation axis of the roughly-working grindstone 25. If the obstacle member 60 is excessively separated away from the injection nozzle 51, the effect to obstruct the current of air is lost. It is preferable that the distance between the arc surface of this obstacle member 60 and the roughly-working grindstone 25 is 1 mm to 3 mm for sufficiently obstructing the current of air.

Although the guide means 40A and 40B are provided near the roughly-working grindstone 25 and the finishing working grindstone 27 in the present embodiment, if other guide means are provided between the roller 33 and the guide means 40B provided at the transfer-in side of the roughly-working grindstone 25 and between the guide means 40A provided at the transfer-out side of the roughly-working grindstone 25 and the guide means 40B provided at the transfer-in side of the finishing working grindstone 27, it is possible to prevent the magnet member 23 from rising from the table 22 more effectively.

<EXPERIMENT 1>

Next, an experiment of a nozzle concerning supplying method of grinding liquid will be explained with reference to FIGS. 14 and 15.

Figure 14A:
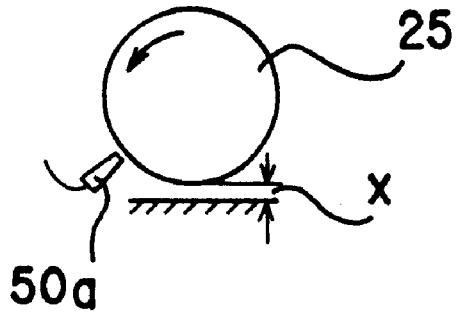
FIGS. 14*a* to 14*d* are views showing structure of nozzles concerning a supply method of grinding liquid.

A nozzle 50*a* shown in FIG. 14*a* is the same as the injection nozzle 51 explained in the third embodiment. That is, the nozzle 50*a* injects the grinding liquid in a direction substantially perpendicular to the grinding surface of the roughly-working grindstone 25. The injection pressure of the grinding liquid from the injection nozzle 50*a* was set to 5 kg/cm$^2$.

Figure 14B:
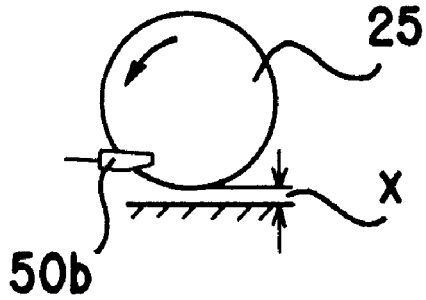

A winding nozzle 50*b* shown in FIG. 14*b* does not inject the grinding liquid. The nozzle 50*b* is disposed such that the grinding surface of the roughly-working grindstone 25 soaks in the grinding liquid.

Figure 14C:
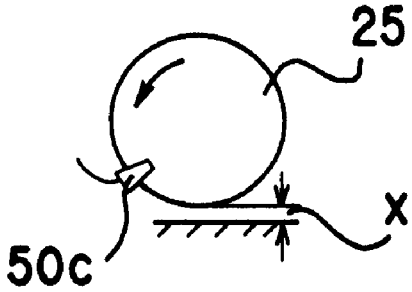

A wide nozzle 50*c* shown in FIG. 14*c* does not inject the grinding liquid, and is disposed such that the grinding surface of the roughly-working grindstone 25 soaks in the grinding liquid similar to the winding nozzle 50*b*. However, the wide nozzle 50*c* supplies the grinding liquid at an angle substantially perpendicular to the grinding surface of the roughly-working grindstone 25.

Figure 14D:
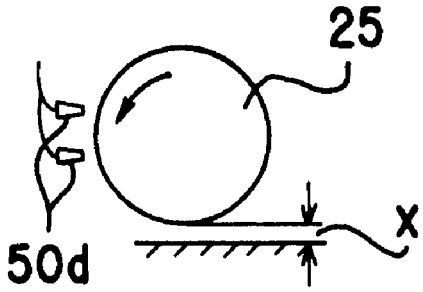

A parallel nozzle 50*d* shown in FIG. 14*d* comprises two nozzles and injects the grinding liquid in a direction substantially perpendicular to the grinding surface of the roughly-working grindstone 25. The injection pressure of the grinding liquid from each of the injection nozzles constituting the parallel nozzle 50*d* is set to 2.5 kg/cm$^2$.

A gap x shown in each of FIGS. 14*a* to 14*d* shows a clearance size between the roughly-working grindstone 25 and a ground surface of a member to be ground. As shown in the drawings, the grinding surface of the roughly-working grindstone 25 is the lowermost portion of the roughly-working grindstone 25.

FIG. 15 show the supplying state of the grinding liquid on the grinding surface with respect to the nozzles shown in FIGS. 14*a* to 14*d*.

Figure 15A:
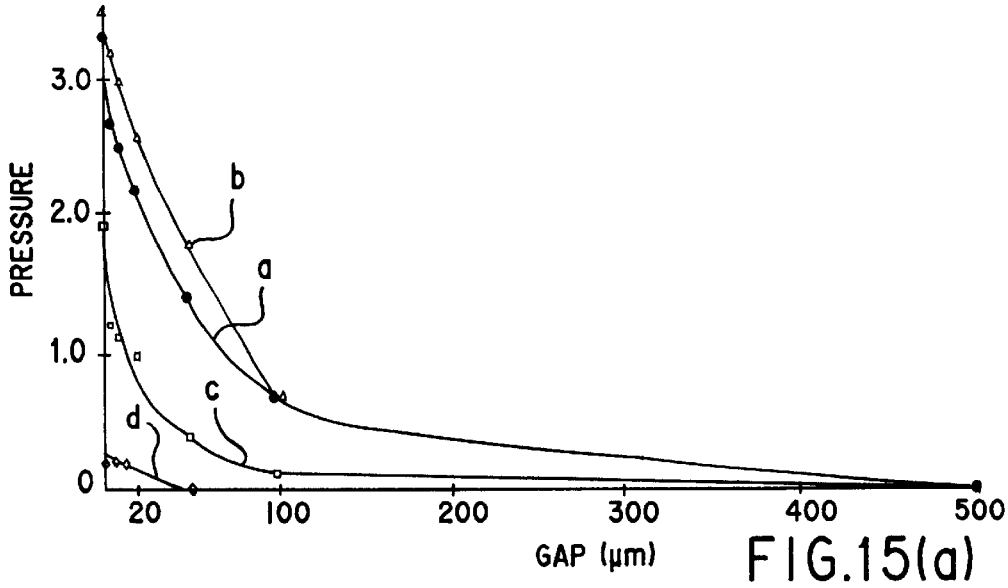
FIGS. 15*a* to 15*c* are graphs showing the supply amount of grinding liquid when various nozzles shown in FIGS. 14 are used.
Figure 15B:
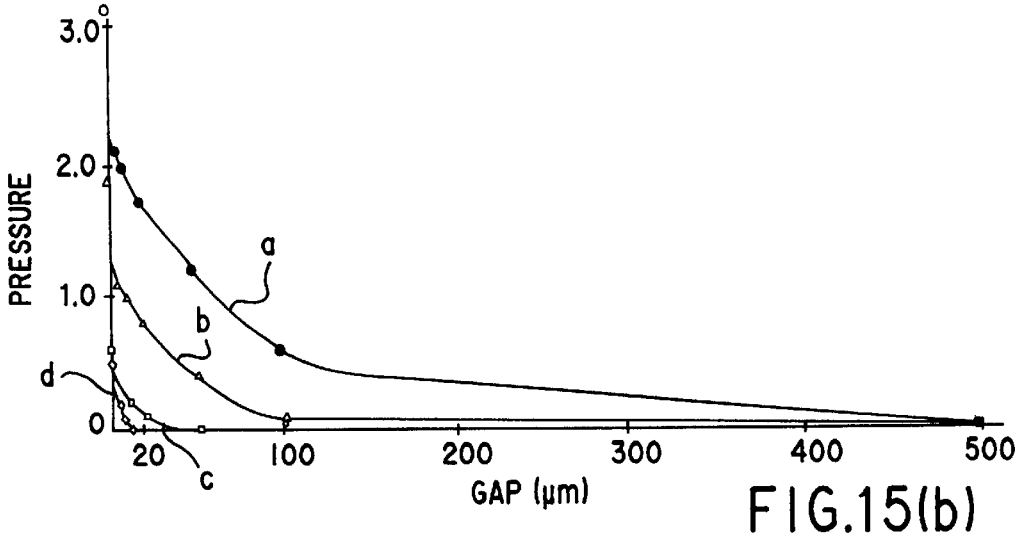
Figure 15C:
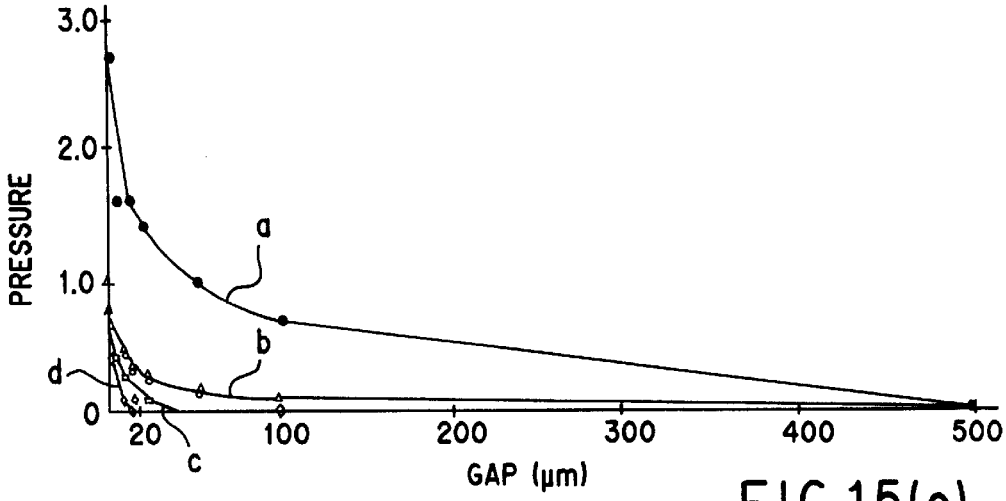

A peripheral speed of the roughly-working grindstone 25 is 1,884 m/minute in FIG. 15*a*, the peripheral speed is 3,768 m/minute in FIG. 15*b*, and the peripheral speed is 5,024 m/minute in FIG. 15*c*.

In each of FIGS. 15*a* to 15*c*, a curve a shows the nozzle 50*a*, a curve b shows the winding nozzle 50*b*, a curve c shows the wide nozzle 50*c* and a curve d shows the parallel nozzle 50*d*. The horizontal axis in each of FIGS. 15*a* to 15*c* shows the gap x between the roughly-working grindstone 25 and the grinding surface of the member to be ground, and the vertical axis shows the pressure at the gap x. Therefore, as the pressure is higher, the larger amount of grinding liquid is supplied.

Especially, as shown in FIGS. 15*b* and 15*c*, it is found that if the nozzle 50*a* is used, more grinding liquid is supplied as compared with other nozzles.

<EXPERIMENT 2>

Next, concerning influence of the current of air generated around the grindstone acting on the obstacle member, experiment on influence of the gap size between the grindstone and the obstacle member will be explained based on FIGS. 16 and 17.

Figure 16:
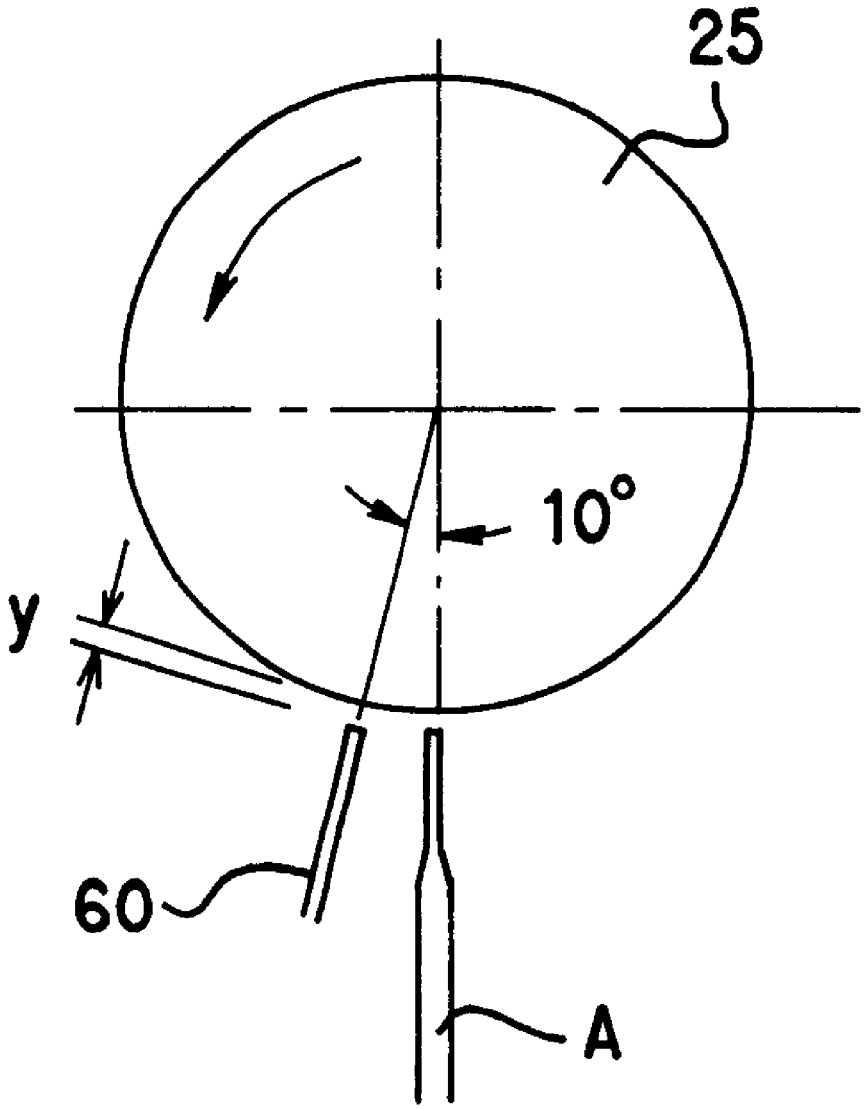
FIG. 16 is a view showing a structure of obstacle members concerning the influence of gap size between a magnet and each of the obstacle members.

An obstacle member 60 shown in FIG. 16 is provided at a position away from a flowmeter A through 10° toward the upstream in the rotation direction. A gap y shows the gap size between the obstacle member 60 and the roughly-working grindstone 25.

Figure 17:
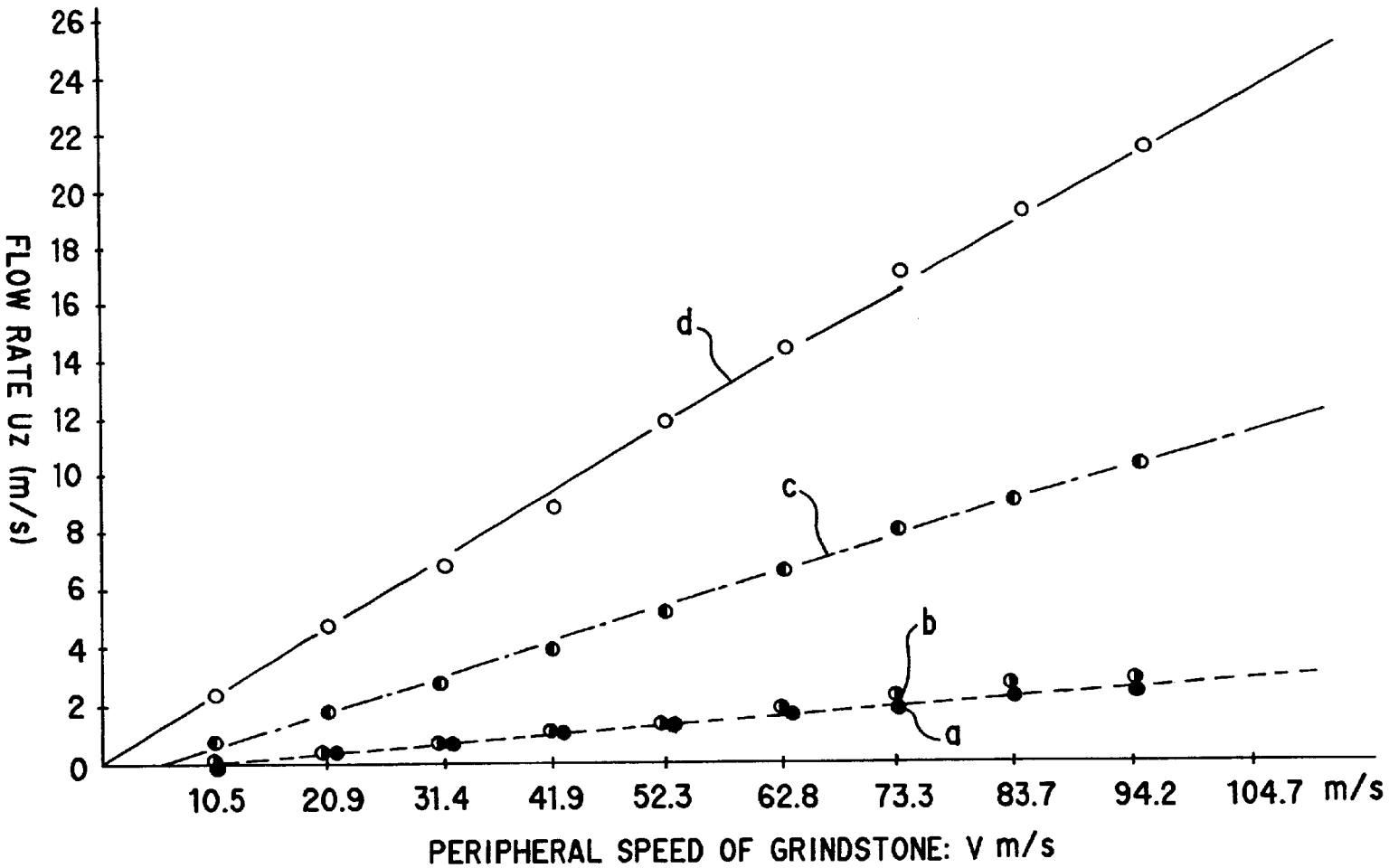
FIG. 17 is a graph showing the flow rate of a current of air generated around outer periphery of the magnet in the structure shown in FIG. 16.

FIG. 17 shows the variation in flow rate measured by the flowmeter A when the gap y shown in FIG. 16 is varied.

In FIG. 17, a straight line a shows the flow rate variation when the gap y is 1 mm, a straight line b shows the flow rate variation when the gap y is 3 mm, and a straight line c shows the flow rate variation when the gap y is 5 mm. A straight line d shows the flow rate variation when the obstacle member 60 is not provided. The lateral axis in FIG. 17 shows the peripheral speed of the roughly-working grindstone 25, and the vertical axis shows the flow rate measured by the flowmeter A.

As shown in FIG. 17, it can be found that the flow rate measured by the flowmeter A is low when the gap y is 1 mm to 3 mm, and the influence of the current of air generated by the rotation of the roughly-working grindstone 25. Generally, if the fact that the roughly-working grindstone 25 is used at the peripheral rotation speed of 31 m to 52 m/second is taken into consideration, the flow rate of the current of air is 4 m/second.

<EXPERIMENT 3>

Next, concerning influence of the current of air generated around the grindstone acting on the obstacle member, experiment on influence of position of the obstacle member will be explained based on FIGS. 18 and 19.

Figure 18:
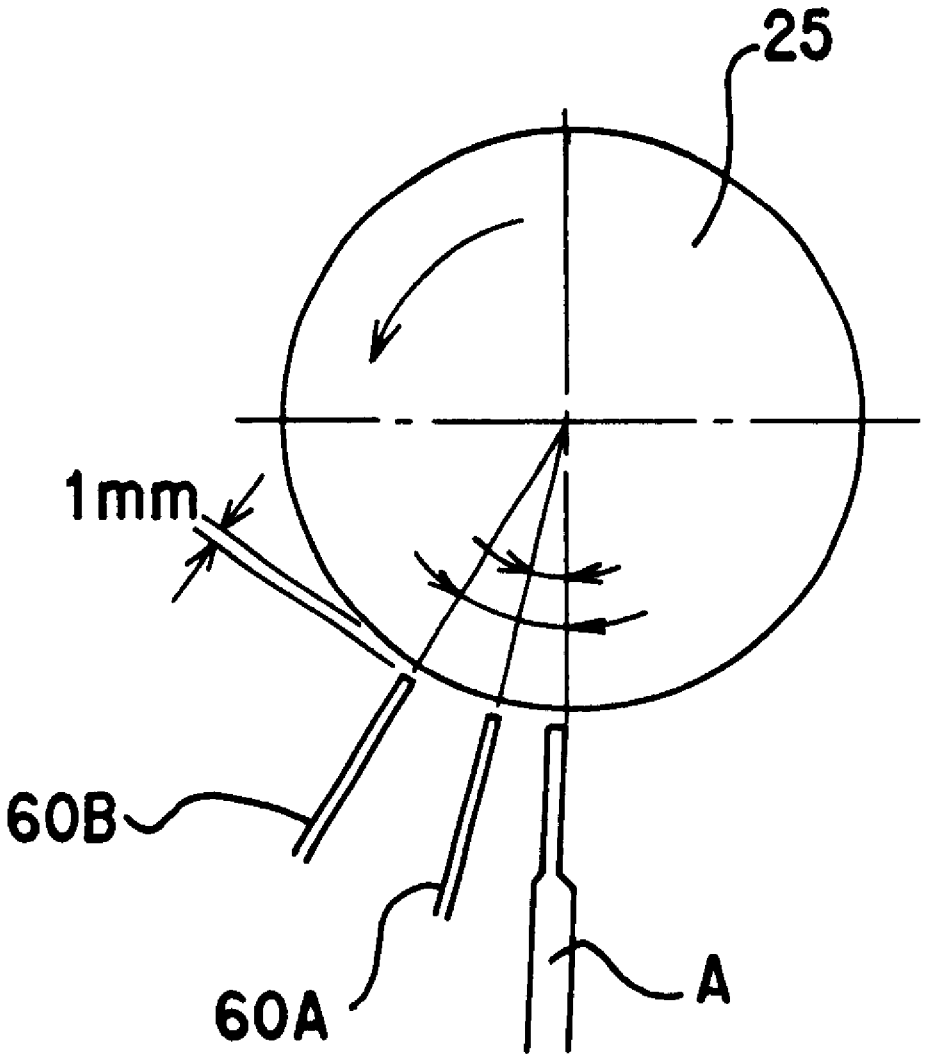
FIG. 18 is a view showing a structure of the obstacle member concerning influence of position.

Gap size between obstacle members 60A, 60B shown in FIG. 18 and the roughly-working grindstone 25 is 1 mm. The obstacle member 60A is provided at a position away from the flowmeter A through 10° toward the upstream in the rotation direction of the roughly-working grindstone 25. The obstacle member 60B is provided at a position away from the flowmeter A through 40° toward the upstream in the rotation direction of the roughly-working grindstone 25.

Figure 19:
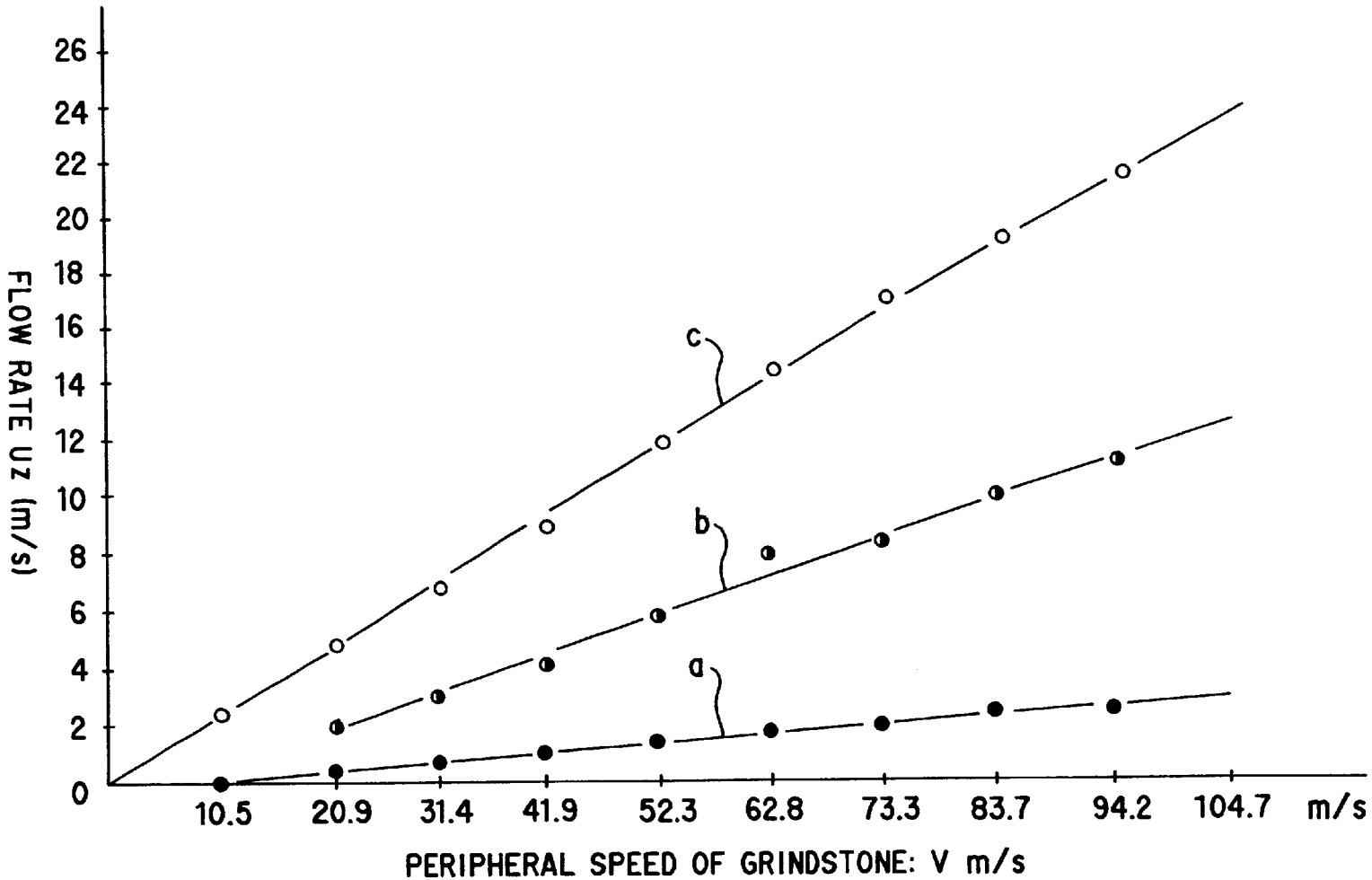
FIG. 19 is a graph showing the flow rate of a current of air generated around outer periphery of the magnet in the structure shown in FIG. 18.

FIG. 19 shows the variation in flow rate measured by the flowmeter A when the obstacle member 60A is provided, when the obstacle member 60B is provided, and when no obstacle member is provided.

In FIG. 19, a straight line a shows the flow rate variation when the obstacle member 60A is used, a straight line b shows the flow rate variation when the obstacle member 60B is used, and a straight line c shows the flow rate variation when no obstacle member is used. In FIG. 19, the lateral axis shows the peripheral speed of the roughly-working grindstone 25, and the vertical axis shows the flow rate measured by the flowmeter A.

Generally, if the fact that the roughly-working grindstone 25 is used at the peripheral rotation speed of 31 m to 52 m/second is taken into consideration, it is preferable that the flow rate of the current of air is 4 m/second. It can be found in FIG. 19 that each of the obstacle members 60A and 60B reduces the influence of the current of air generated by the rotation of the roughly-working grindstone 25. Therefore, it is preferable that the obstacle member is provided in a range of 10° to 60° before the grinding liquid supplying means.

<EXPERIMENT 4>

Next, a magnet member worked by the working apparatus of the magnet member by the above-described embodiments will be explained based on FIG. 20.

Figure 20:
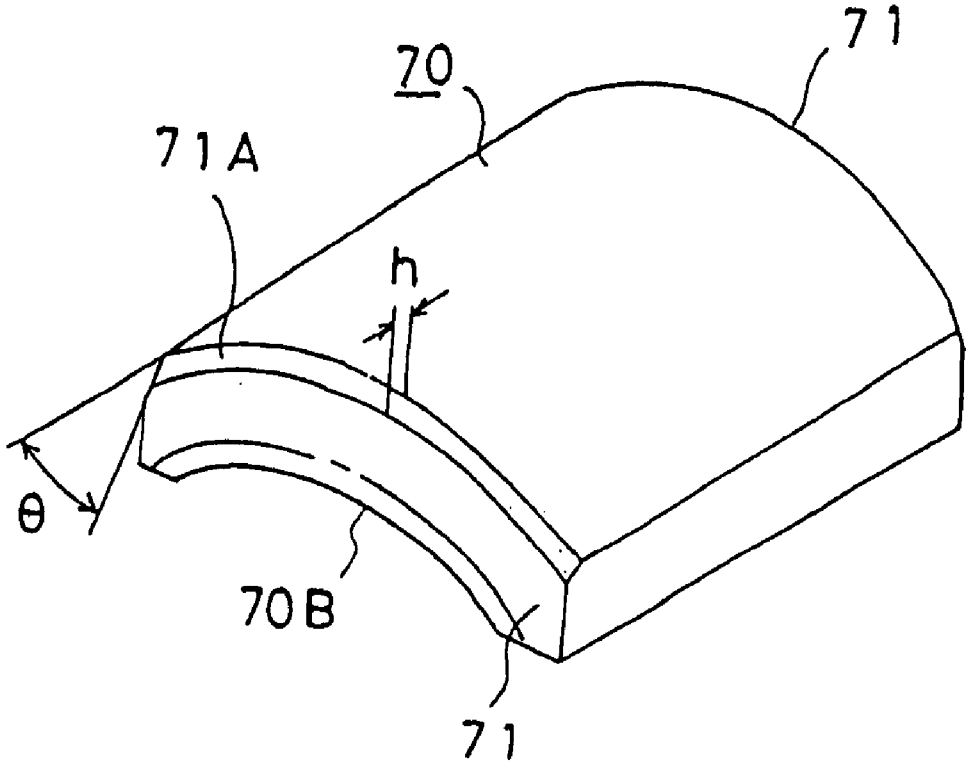
FIG. 20 is a perspective view of a magnet member to be worked by the working apparatus of the magnet member according to the embodiment of the invention.

As shown in FIG. 20, a magnet member 70 is chamfered at its upper surface side ends 71A and lower surface side ends 71B of opposite end surface 71 against which other magnet members 70 abut during the transfer. It is preferable that the upper surface side ends 71A and the lower surface side ends 71B are chamfered such that the chamfer width h is 1 mm to 5 mm, and the chamfer angle θ from the grinding surface is 60° to 80°. By chamfering the upper surface side ends 71A and the lower surface side ends 71B of opposite end surface 71 against which other magnet members 70 abut during the transfer in this manner, the pushing pressure is not concentrated on the ends 71A and 71B and therefore, it is possible to prevent cracks due to contact between the magnet members 70 during the grinding working.

Further, an R-Fe-B rare-earth sintered magnet can be used as the magnet member 70. Also when the sintered magnet is used as the magnet member 70, it is preferable to chamfer the magnet as shown in FIG. 20.

Possibility of Industrial Utilization

According to the present invention, it is possible to stably work a plurality of surfaces of a magnet member in one step. Therefore, it is possible to provide a working apparatus and a working method of the magnet member having excellent productivity.

Further, according to the invention, it is possible to supply the grinding liquid more reliably, and the productivity can be enhanced.

Further, according to the invention, the permeability of the grinding liquid is enhanced, the cooling effect is enhanced, the temperature rise at the grinding portion is prevented and therefore, the seizing or deformation of the grinding means is not caused easily.

What is claimed is:

1. A working apparatus of a magnet member comprising: a transfer path for guiding magnet members to be ground in one direction; transfer means for pushing the plurality of magnet members in a transfer direction to continuously send out said magnet members to said transfer path; a pair of grinding means disposed such as to be opposed to each other and sandwich said transfer path for grinding opposite surfaces of said transferred magnet member; and pushing means disposed downstream from said grinding means for pushing said magnet member in a direction opposite from said transfer direction.

2. A working apparatus of a magnet member according to claim 1, wherein said pushing means is grinding means for finishing, by polishing, one of surfaces of said magnet member which has been ground by said pair of grinding means.

3. A working apparatus of a magnet member according to claim 2, wherein said pair of grinding means comprise grindstones disposed above and below said transfer path, said grindstone disposed below said transfer path forms a flat surface on a lower surface of said magnet member, and said pushing means finishes, by polishing, an upper surface of said magnet member using said flat surface of the magnet member as the reference.

4. A working method of a magnet member comprising the steps of: transferring a plurality of magnet members in one direction to continuously transfer said magnet members, concurrently pushing said magnet member in a direction opposite from the transfer direction, and concurrently grinding opposite surfaces of said magnet member simultaneously by a pair of grinding means disposed such as to be opposed to each other and sandwich said magnet member.

5. A working apparatus of a magnet member characterized in that a plurality of magnet members are continuously transferred to a transfer path, a pair of grinding means opposed to each other and rotated in a direction opposite from the transfer direction, and said grinding means grinds said magnet member while said grinding means pushes said magnet member in the direction opposite from the transfer direction.

6. A working apparatus of a magnet member characterized in that a plurality of magnet members are continuously transferred to a transfer path, pushing means pushes said magnet member in a direction opposite from the transfer direction, and a pair of grinding means opposed to each other and grinding said magnet member pushed by said pushing means.

7. A working apparatus of a magnet member according to any one of claims 1, 5 and 6, wherein said magnet member is a sintered magnet.

8. A working apparatus of a magnet member according to any one of claims 1, 5 and 6, wherein an R-Fe-B rare-earth sintered magnet is used as said magnet member, and said pushing means or said grinding means applies a pushing force of 10 kg/mm$^2$ or less to said magnet member.

9. A working apparatus of a magnet member according to any one of claims 1, 5 and 6, wherein guide means for suppressing said magnet member from rising from said transfer path is provided in the vicinity of said grinding means.

10. A working apparatus of a magnet member according to claim 9, wherein said guide means is provided in front and behind said grinding means.

11. A working apparatus of a magnet member according to claim 9, wherein said guide means is provided with grinding liquid supplying means.

12. A working apparatus of a magnet member according to claim 11, wherein an injection direction of a grinding liquid from said grinding liquid supplying means is substantially perpendicular to a grinding surface of said grinding means.

13. A working apparatus of a magnet member according to claim 11, wherein an obstacle member is provided adjacent said grinding surface of said grinding means.

14. A working apparatus of a magnet member according to claim 13, wherein a distance between said obstacle members and said grinding surface of said grinding means is 1 mm to 3 mm.

15. A working apparatus of a magnet member according to claim 13, wherein said obstacle members is provided in a region between 10° to 40° around the rotation axis of said grinding means back from said grinding liquid supplying means.

16. A working apparatus of a magnet member according to claim 13, wherein said obstacle means is constituted by said guide means.

17. A working method of a magnet member characterized in that a plurality of magnet members are continuously transferred, a pair of grinding means opposed to each other is rotated in a direction opposite from the transfer direction, and said magnet member is pushed in the direction opposite from the transfer direction by said grinding means and in such a state, said magnet member is ground by said grinding means.

18. A working method of a magnet member characterized in that a plurality of magnet members are continuously transferred, said magnet member is pushed in the opposite direction from the transfer direction by pushing means, and said magnet member pushed by said pushing means is ground by grinding means opposed to each other so as to sandwich said magnet member.

19. A working method of a magnet member according to any one of claims 4, 17 and 18, wherein said magnet member is a sintered magnet.

20. A working method of a magnet member according to any one of claims 4, 17 and 18, wherein an R-Fe-B rare-earth sintered magnet is used as said magnet member, said magnet member is pushed by a pushing force of 10 $kg/mm^2$ or less and is transferred.

21. A working method of a magnet member according to any one of claims 4, 17 and 18, wherein a grinding liquid is injected to said grinding means.

22. A working method of a magnet member according to claim 21, wherein the injection pressure of said grinding liquid is 5 $kg/cm^2$ or greater.

23. A working method of a magnet member according to claim 21, wherein a grinding liquid having surface tension of 25 $dyn/cm^2$ to 60 $dyn/cm^2$ is used as said grinding liquid.

24. A working method of a magnet member according to claim 21, wherein the coefficient of kinetic friction between said magnet member and said grinding means is set to 0.1 to 0.3 by using said grinding liquids.

25. A working method of a magnet member according to claim 21, wherein a grinding liquid comprising water as the main ingredient is used as said grinding liquid.

26. A working method of a magnet member according to claim 21, wherein an antifoaming agent is included in said grinding liquid.

27. A working method of a magnet member according to claim 21, wherein said grinding liquid is injected to said grinding surface of said grinding means substantially perpendicularly.

28. A working method of a magnet member according to any one of claims 4, 17 and 18, wherein an end of said magnet member is chamfered before it is transferred.

29. A working method of a magnet member according to claim 28, wherein a width of the chamfer of said magnet member is 1 mm to 5 mm.

30. A working method of a magnet member according to claim 28, wherein an chamfer angle of said magnet member is 60° to 80° with respect to said grinding surface of said magnet member.

* * * * *